US008991915B1

(12) United States Patent
Mittelsted

(10) Patent No.: US 8,991,915 B1
(45) Date of Patent: Mar. 31, 2015

(54) TRAY FOR FOLDABLE CHAIRS

(71) Applicant: Stanley Mittelsted, Alvin, TX (US)

(72) Inventor: Stanley Mittelsted, Alvin, TX (US)

( * ) Notice: Subject to any disclaimer, the term of this patent is extended or adjusted under 35 U.S.C. 154(b) by 300 days.

(21) Appl. No.: 13/719,911

(22) Filed: Dec. 19, 2012

(51) Int. Cl.
*A47C 7/62* (2006.01)
*A47B 83/02* (2006.01)

(52) U.S. Cl.
CPC ..... *A47B 83/02* (2013.01)
USPC ... 297/188.2; 297/16.2; 297/135; 297/188.12

(58) Field of Classification Search
CPC ..... B60N 3/002; A47B 31/06
USPC ..... 297/16.2, 135, 144, 188.12, 188.2; 108/44, 45
See application file for complete search history.

(56) References Cited

U.S. PATENT DOCUMENTS

| | | | | |
|---|---|---|---|---|
| 2,299,025 | A * | 10/1942 | McGinley | 108/44 |
| 4,805,867 | A * | 2/1989 | McAllister | 248/441.1 |
| 4,915,035 | A * | 4/1990 | Clark et al. | 108/44 |
| 5,649,737 | A | 7/1997 | Behnke | |
| 5,709,155 | A | 1/1998 | Terracciano | |
| 5,865,124 | A | 2/1999 | Wroe | |
| 5,893,331 | A | 4/1999 | Diletto | |
| 5,893,605 | A * | 4/1999 | Chang | 297/188.14 |
| 5,975,626 | A * | 11/1999 | Aycock | 297/16.1 |
| 6,017,085 | A | 1/2000 | LaCroix | |
| 6,691,627 | B2 | 2/2004 | Einsel | |
| 6,899,386 | B2 | 5/2005 | Antone | |
| 7,290,746 | B1 | 11/2007 | Macias | |
| 7,413,254 | B2 * | 8/2008 | Petre, Jr. | 297/440.1 |
| 7,950,335 | B1 * | 5/2011 | Almond et al. | 108/42 |
| D687,040 | S * | 7/2013 | Meadows et al. | D14/447 |
| 2009/0084291 | A1 * | 4/2009 | Long | 108/44 |

* cited by examiner

*Primary Examiner* — Matthew Ing
(74) *Attorney, Agent, or Firm* — Egbert Law Offices, PLLC

(57) ABSTRACT

A utility tray apparatus is provided which is attachable to lightweight foldable chairs. The chairs generally consist of tubular frames with fabric seat and backrests. The utility tray apparatus has a body portion and a tray portion. The body portion has two channels formed therein. The channels are suitable for receipt of the tubular leg members of the chair. The channels are tapered such that an interference fit is achieved when the diameter of the tubular leg member matches the width of the respective channel. An attachment member may be provided which fits within the channels of the body portion. The attachment member having a clamp on the bottom thereof suitable for clamping to a square or circular tubular member, such as a rail on a deer stand.

18 Claims, 6 Drawing Sheets

TRAY FOR FOLDABLE CHAIRS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to lightweight foldable travel or camping chairs. More particularly, the present invention the relates to an attachable tray for lightweight foldable travel or camping chairs. Even more particularly, the present invention the relates to a tray attachable to foldable chairs as well as other square or round tubular members.

2. Description of Related Art Including Information Disclosed Under 37 CFR 1.97 and 37 CFR 1.98

Common today are lightweight foldable chairs, also known as travel, camping, or sport chairs. These are easily transportable, and provide quick seating while attending sporting events, campgrounds, and other areas with limited seating. These chairs normally have a tubular frame connected with pivot points and covered with nylon or other weather-resistant fabric for the arms, back and seat. They create width as a seating area and depth as a backrest when unfolded.

An example of such a chair is shown FIG. 1. The chair 10 has a seating area 12 and a frame 14. The frame 14 is composed of a number of tubular leg members 18. These tubular leg members 18 have a round cross section or circular cross section and meet and are pivotally connected together at a number of intersection points 16.

When not in use, these types of chairs are folded up and kept in a carrying bag normally made from the same material the chair is made from. While most chairs have a weight rating of 225 pounds, recently with the use of larger diameter tubing some of these chairs have ratings of 400 to 500 pounds. There are also smaller versions of these types of chairs made for children.

While these chairs provide a quick elevated place to sit, the areas at ground level are not the best places to set drinks, snacks, a purse, glasses, magazines, etc. Recently, some of these chairs have been designed to include a collapsible drink holder in the arm portion of the chair, but no suitable place for other items.

Various patents have issued in the past relating to chairs with attachments thereon, and other methods and apparatuses for attaching items to folding chairs. For example, U.S. Pat. No. 5,649,737, issued on Jul. 22, 1997 to Behnke, teaches a chair tray. The chair tray has a tray, a block joined to the tray, and a brace pivotally connected to the block. The block is supported on a horizontal portion of a chair arm, and the brace is placed against a vertical portion of the chair arm. Spring clips clamp the tray and block to the chair arm horizontal portion and the brace to the chair arm vertical portion. The chair tray can also be attached to the vertical leg using mushroom heads and a cut out slot.

U.S. Pat. No. 5,709,155, issued on Jan. 20, 1998 to Terracciano, describes a chair tray which is attachable to a lawn chair arm using a bracket with pins and a hinged bracket. The mount bracket is attached to the arm of the chair. Pin tracks are disposed in the mount bracket. A hinge bracket is attached to a tray table. Pin holes are disposed in the hinge bracket. The hinge bracket is pivotally engaged to the mount bracket by a clevis pin that extends through the pin holes and the pin tracks. The tray table can be moved from a first position where the tray table is maintained in a horizontal position, to a second position in which the tray table is free to rotate to the side of the chair. In the horizontal position, tabs on the hinge bracket engage slots in the mount bracket, thereby retaining the tray table in the horizontal position.

U.S. Pat. No. 5,865,124, issued on Feb. 2, 1999 to Wroe, describes a tray for a lawn chair which uses a cylindrical clamping mechanism to attach the tray thereto. The table attachment for lawn chairs and the like includes a gripping foot having a pair of semi-cylindrical members which are frictionally engageable to clamp about a leg of a chair on which the table attachment is to be mounted, one of the semi-cylindrical members having an externally-threaded neck portion projecting outward and upward therefrom, a tubular angle member having an internally-threaded end mateable with the neck portion and having a the opposite end castellated, a generally fan-shaped table platform having an opening formed adjacent the narrow end thereof for receiving a drinking glass and having a shaft projecting downwardly from the table platform adjacent the narrow end formed with a castellated interior mateable with the opposite end of the angle member.

U.S. Pat. No. 5,893,331, issued on Apr. 13, 1999 to Diletto, essentially teaches a tray with a telescoping hinged leg using a c-clamp, thumb screws and velcro. The structure includes a tray of a substantially rectangular configuration having a telescoping hinged leg mounted to the bottom of the tray at one side thereof and projecting portions on the opposite side extending outwardly to fixedly engage clamp members in mating apertures. The clamp members mount to the side of a lounge chair or chaise while the telescoping leg is extended at a right angle to the tray and rests upon the ground where it is locked place.

U.S. Pat. No. 6,017,085, issued on Jan. 25, 2000 to LaCroix, describes a folding chair tray which attachable to the folding chair arm using thumb screws. The LaCroix tray is directed towards the type of folding chairs which are less common currently.

U.S. Pat. No. 6,691,627, issued Feb. 17, 2004 to Einsel, describes a height adjustable lawn chair table. The height adjustable lawn chair table is attachable to the arm of the lawn chair using velcro. Height adjustable means allow the table to be adapted to various types of lawn chairs.

U.S. Pat. No. 7,290,746, issued on Nov. 6, 2007 to Macias, teaches a tray which is attachable to a chair. The tray is attachable to the chair by utilizing a member which fits within the pre-existing beverage holder on the chair arm.

Notably absent from the prior art discussed hereinabove is prior art pertaining to trays which are easily detachable and attachable to the lightweight foldable chairs. One notable example is found, however. U.S. Pat. No. 6,899,386, issued on May 31, 2005 to Antone, describes a folding chair tray assembly. The tray of the Antone patent uses a table top platform connected to both arms of the chair with a pair of bracket assemblies.

Chair manufactures have also responded to public need for such a tray by developing foldable chairs with a fabric tray. The fabric tray is fixed to chair with long tubes and sliding clamp mechanisms. There are a number of disadvantages to having the tray built into the folding chair mechanism.

Most of the prior art relates to trays for folding beach or lounge chairs, director type, and lawn chairs. Some prior art has provided a tray or tabletop attachments that require a strictly vertical tube or horizontal arm to attach to. Others are complex with attachment points requiring hardware such as screws, clamps, pins, ferrules, hinges or clips. Some use snaps, brackets and hook-and-loop (Velcro) straps. Further, others require attachment to and are limited to only one side of the chair. Some are attached to the arms of the chairs making the chairs easy to tip over. Many are not accessible to the general public. Others are expensive to produce or purchase. Some, when attached inhibit the ability to exit the chair. Thus, none of the prior art solutions is entirely satisfactory.

It is the primary object of the present invention to provide a utility apparatus for lightweight foldable chairs which can be easily attached, detached, and stored.

It is another object of the present invention to provide a utility tray apparatus that can be stored in a drawstring or backpack style bag made of nylon or other weather resistant materials.

It is another object of the present invention to provide a utility tray apparatus that can fit a plurality of leg tubing diameters of foldable chairs.

It is yet another object of the present invention to provide a utility tray which is attached at a low point on the side of the foldable chair to keep the chair from tipping over when exiting.

It is yet another object of the present invention to provide a utility tray apparatus that requires no hardware for attachment to the foldable chair.

It is another object of the present invention to provide a utility tray apparatus which attaches above the intersecting leg support hinge point at the angle created by the unfolding of the chair.

It is another object of the present invention to provide a utility tray apparatus that can be attached to any side of the chair.

It is yet another object of the present invention to provide a utility tray apparatus having a drink holder or compartments to secure other objects.

It is further object of the present invention to provide a utility tray apparatus that is relatively easy and inexpensive to manufacture, which can be produced in a variety of materials.

It is another object of the present invention to provide a utility tray apparatus that can have a logo or trademark placed on the tray surface.

These and other objects and advantages of the present invention will become apparent from a reading of the attached specification and appended claims.

BRIEF SUMMARY OF THE INVENTION

The present invention is an apparatus attachable to a folding chair, the apparatus having a tray and a body portion affixed to the tray. The body portion has a first end and a second end. A first channel is formed in the body portion and opens to the first end of the body portion and extends toward a center of the body portion. The first channel has a width decreasing from the first end of the body portion toward the center of the body portion. A second channel is also formed in the body portion and opens to the second end of the body portion and extends toward the center of the body portion. The second channel has a width decreasing from the second end of the body portion toward the center of the body portion.

In the present invention, each of the first and second channels have a first face extending parallel to the longitudinal axis of the body portion and a second face opposite the first face. The second face extends at an acute angle relative to the longitudinal axis of the body portion. The first face of the first channel is in alignment with the first face of the second channel.

The folding chair has a first tubular leg and a second tubular leg in a crossed configuration. The first channel is suitable for interference fit with the first tubular leg of the folding chair and the second channel is suitable for interference fit with the second tubular leg of the folding chair.

The first faces of the first and second channels may have angular steps defining first and second widths between the respective first and second faces of the channels. A cantilever member may be affixed to and extend outwardly from the body portion and may be affixed to or formed with tray. The first and second channels may have a respective abutment surface opposite the ends of the body portion In one embodiment of the present invention, the first and second channels define a female portion. A male portion may be provided which is engageable with the female portion. The male portion has a clamp for clamping the male portion to a surface thereunder.

The present invention is also an apparatus including a folding chair with first and second tubular legs in a crossed configuration, a body portion having a first end and a second end, and first and second channels. The first channel opens to the first end of the body portion and extends toward the center of the body portion. The first channel has a width decreasing from the first end of the body portion toward the center of said body portion and is suitable for interference fit with the first tubular leg of the folding chair. The second channel opens to the second end of the body portion and extends toward the center of said body portion. The second channel has a width decreasing from the second end of the body portion toward the center of the body portion, and is suitable for interference fit with the second tubular leg of the folding chair.

A tray may be affixed to the body portion. The first channel and said second channel each may have a stepped configuration. The first and second channels may have an abutment surface opposite the respective ends of the body portion.

The present invention is also a tray table attachable to a folding chair and other items. The tray table includes a tray and a body portion affixed to the tray. The body portion has a first end and a second end. A first channel is formed in the body portion opens to the first end of the body portion and extends toward the center of the body portion. The first channel has a width decreasing from the first end of the body portion toward the center of said body portion. A second channel is also formed in the body portion opens to the second end of the body portion and extends toward the center of the body portion. The second channel has a width decreasing from the second end of the body portion toward the center of the body portion. A male member is engageable within the first channel and the second channel. The male portion has a clamp for clamping the male portion to a surface thereunder, such as a square or circular tubular member. Each of the first channel and second channels includes a first face extending parallel to the longitudinal axis of the body portion, and a second face opposite the first face. The second face extends at an acute angle relative to the longitudinal axis of the body portion.

The first face of the first channel is in alignment with the first face of the second channel. The folding chair has a first tubular leg and a second tubular leg in a crossed configuration. The first channel is suitable for interference fit with the first tubular leg of the folding chair, and the second channel is suitable for interference fit with the second tubular leg of the folding chair. The second faces of the first and second channels each have angular steps defining first and second widths between respective first and second faces.

The foregoing section is described, in generality, the preferred embodiment of the present invention. It is understood that modifications to this preferred embodiment can be made within the scope of the present invention. This section is not to be construed, in any way, as limiting of the scope of the present invention. The present invention should only be limited by the following claims and their legal equivalents.

DETAILED DESCRIPTION OF THE INVENTION

Figure 2:
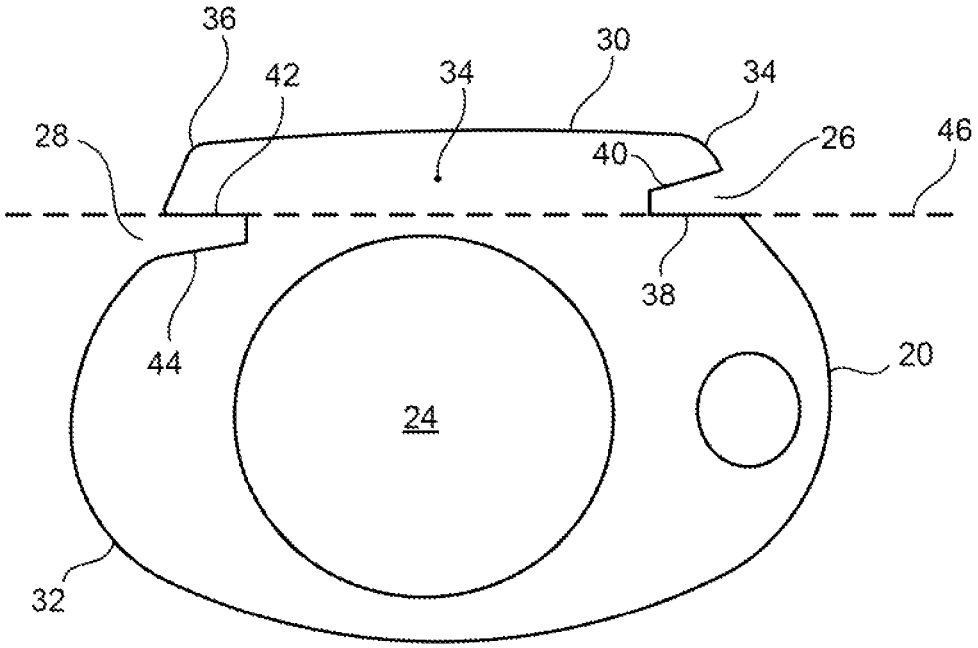
FIG. 2 is a top view of the utility tray apparatus of the preferred embodiment of the present invention.

Referring to FIG. 2 there is shown the utility tray apparatus 20 of the preferred embodiment of the present invention. The utility tray apparatus 20 is shown having a body portion 30 and a tray portion 32. The tray portion 32 is shown as having a cup holder 22 and a plate depression 24. While the tray portion 32 is shown as having a generally oval configuration, various other configurations such as squared or rectangular tray portions are also envisioned by the inventor. The top surface of the tray portion 32 would be suitable for showing a logo or trademark, such as a football mascot.

The body portion 30 of the utility tray apparatus 20 has a first end 34 and a second end 36. A center point 37 is shown for reference. The body portion 30 has a first channel 26 opening to the first end 34 of the body portion 30. The first channel 26 has a straight face 38 and a tapered face 40. The body portion 30 also has a second channel 28 opening to the second end 36 of the body portion 30. Similarly, the second channel 28 has a straight face 42 and a tapered face 44. As can be seen in FIG. 2, the straight faces 38 and 42 are aligned along imaginary line 46.

Figure 1:
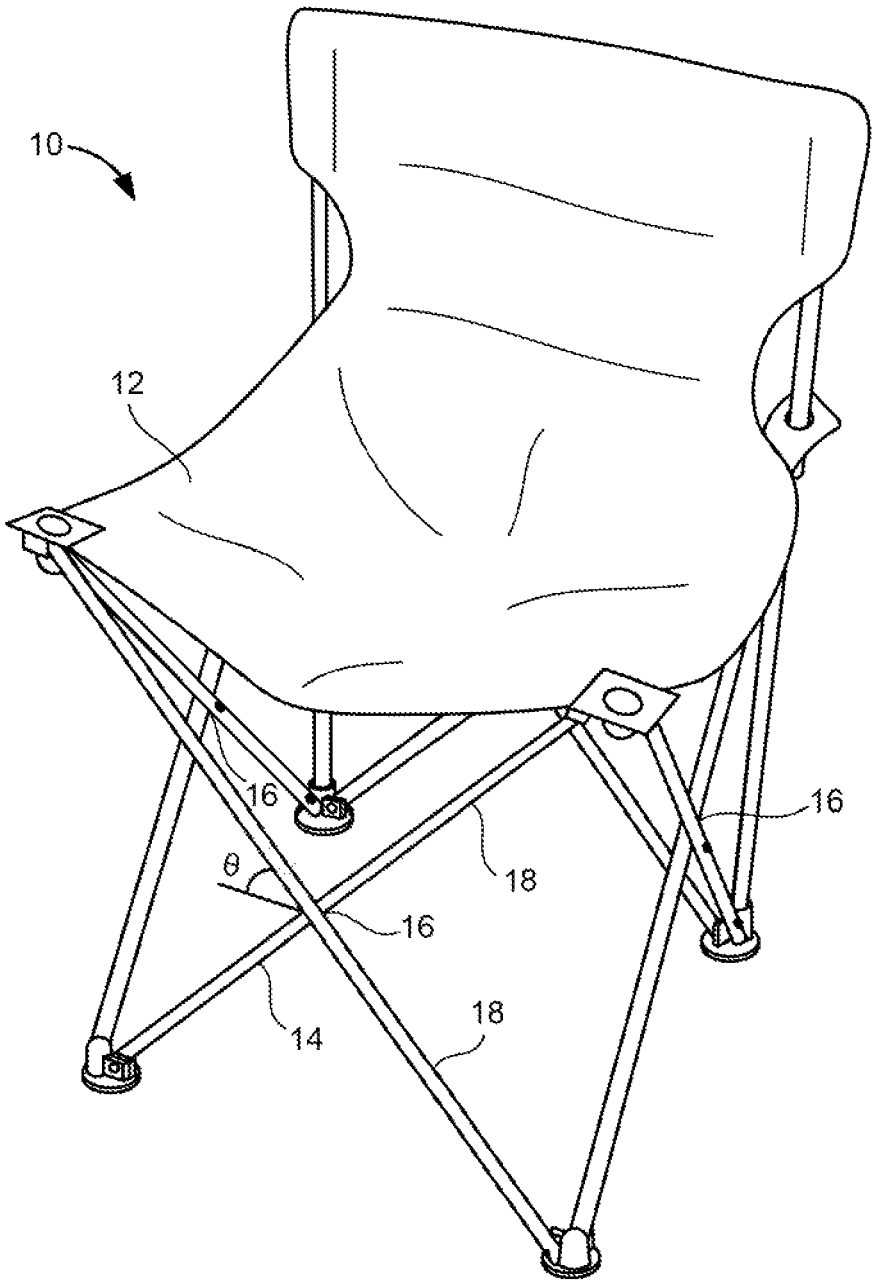
FIG. 1 Prior Art
FIG. 1 shows a perspective view of a conventional foldable chair.

Referring to FIG. 1, it can be seen how the foldable chair 10 has a plurality of tubular leg members 18 which intersect and are pivotally connected together at various intersection points 16. The utility tray apparatus 20 can be positioned on any of the intersection points 16. Preferably however, the utility tray apparatus 20 is positioned on one of the intersection points 16 on the sides of the chair adjacent the arms of the chair.

Referring back to FIG. 2, the channels 26 and 28 of the body portion 30 receive the leg members 18. The intersection point 16 of the chair is generally positioned below the center point 37 of the body portion 30.

The tapered arrangement of the faces of the channels 26 and 28 allow for various sizes of tubular leg members 18 to be accommodated within the channels. Depending on the size of the tubular leg members 18 or the diameter of the tubular leg members 18, the leg members 18 will interference fit within the respective channels at the depth within the channel wherein the width of the channel matches the diameter of the leg member. Thus, the utility tray apparatus 20 can be used on all sizes of folding chairs and can be easily attached and detached therefrom.

Figure 3:
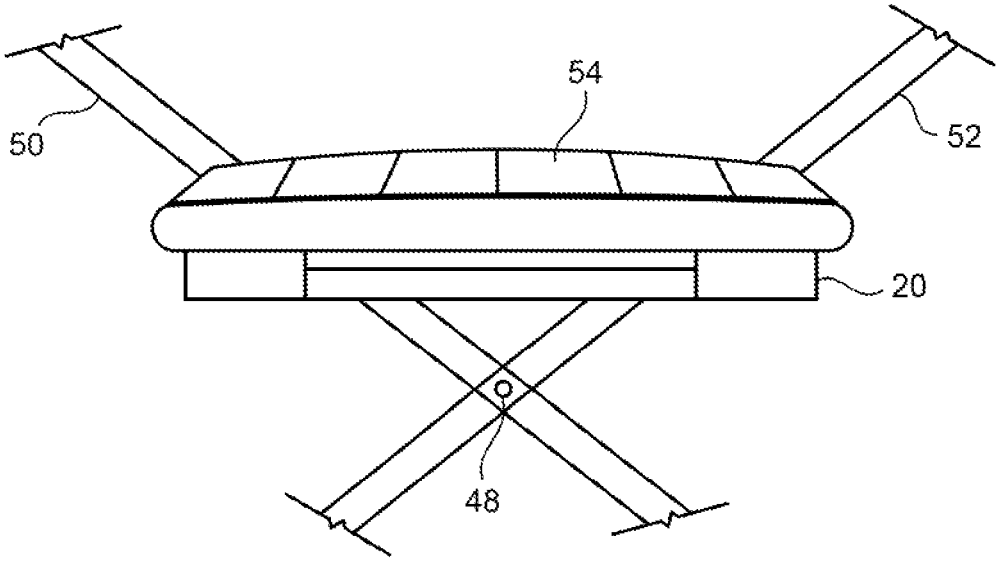
FIG. 3 is a perspective view of the utility tray apparatus of the present invention attached to the legs of a foldable chair.

Referring to FIG. 3, there is shown a perspective view of the utility tray apparatus 20 affixed to the legs of a chair. As can be seen in FIG. 2, the utility tray apparatus rests above the intersection point 48 of the first leg 50 and the second leg 52. The legs 50 and 52 are received within the channels of the utility tray apparatus 20. Also shown in the FIG. 3 is the top surface of the tray portion 32. Resting just above the intersection point 48, the utility tray apparatus is low enough on the chair so as to prevent tipping over when exiting the chair.

Figure 4:
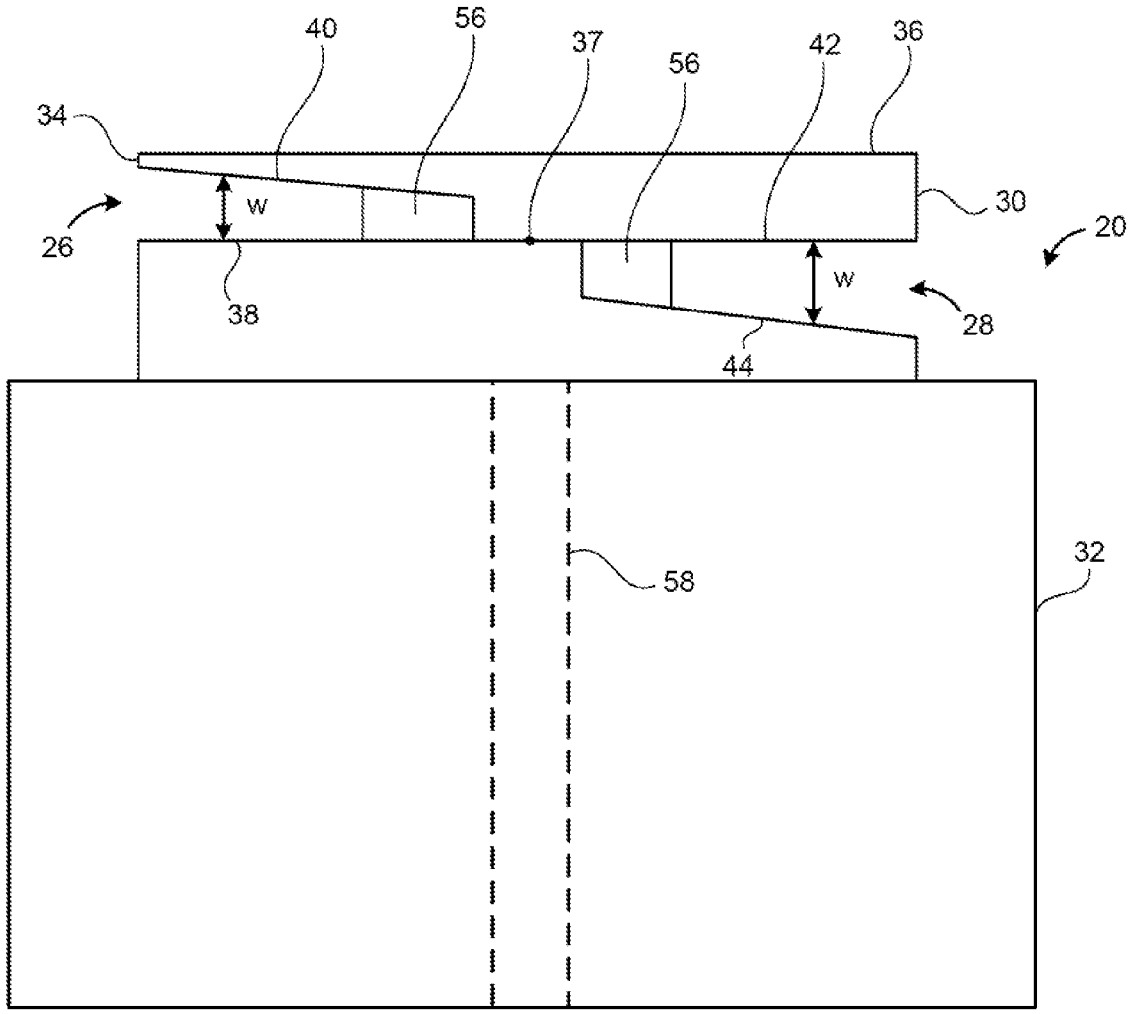
FIG. 4 is a bottom view of the utility tray apparatus of the present invention.

Referring to FIG. 4, the is shown a bottom view of the utility tray apparatus 20 of the present invention. In FIG. 4, the taper of the various channels can be more easily seen. In FIG. 4, it can be seen that a width W is defined between the respective tapered and straight sides of the respective channels. As the channels approach the center point 37, the width decreases. Also shown in FIG. 4 are the solid portions 56 located within the first channel 26 and the second channel 28. The solid portions 56 are angled upwardly at an angle which approximately matches the angles θ made by the intersecting leg members as shown in FIG. 1.

Also shown in FIG. 4 is an optional cantilever member 58. The cantilever member 58 extends from and is attached to the body portion 30. The cantilever member 58 can be formed within or on a top or bottom side of the tray portion 32. The cantilever member 58 provides additional stability to the utility tray apparatus 20 of the present invention.

Figure 5A:
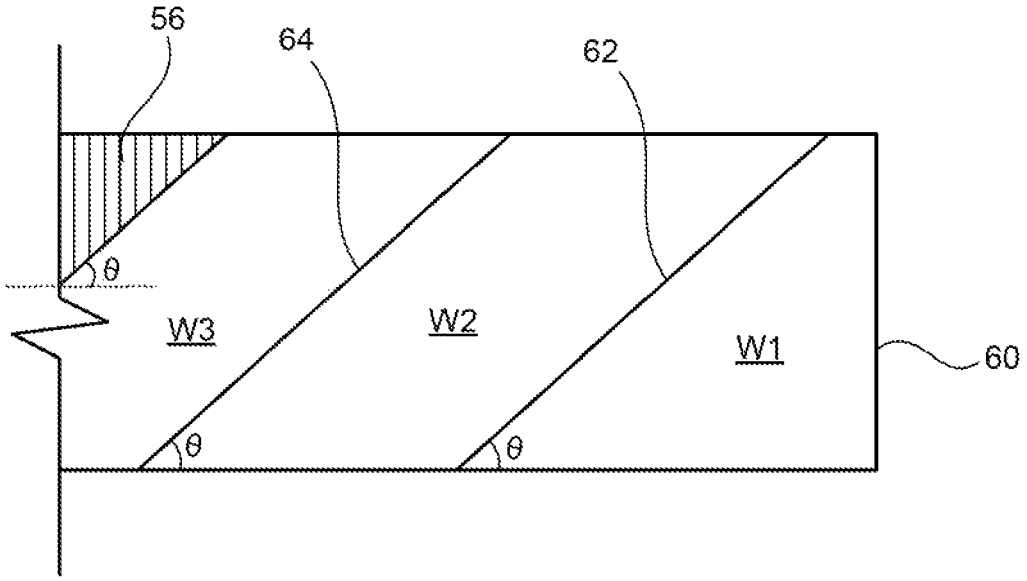
FIG. 5*a* is an isolated view of the tapered face of one of the channels of the utility tray apparatus of the present invention.
Figure 5B:
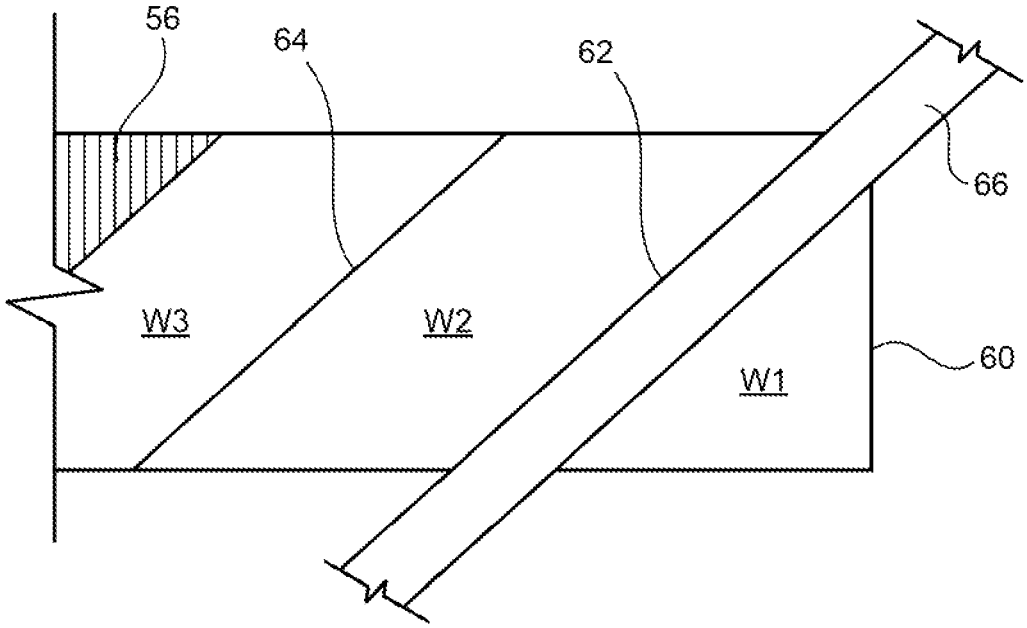
FIG. 5*b* is an isolated view of the face as shown in FIG. 5*a*, wherein a large diameter tubular leg member is received by the channel.
Figure 5C:
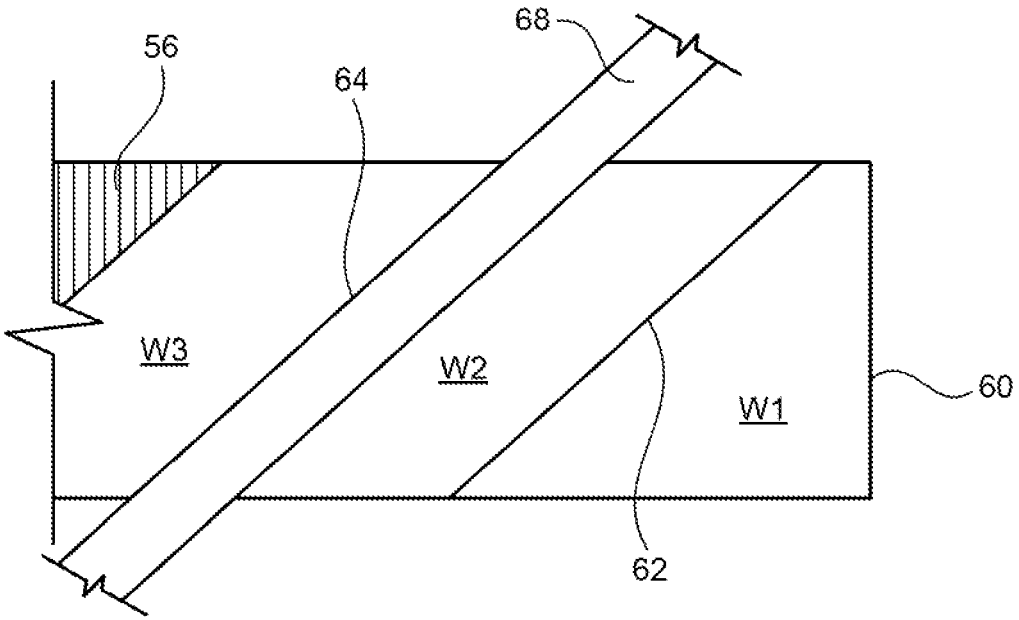
FIG. 5*c* is an isolated view of the face as shown in FIGURE Sa, wherein a medium diameter tubular leg member is received by the channel.

FIGS. 5*a*-5*c* show isolated, partially cross-sectional views of a tapered face 60 of a preferred embodiment of the present invention. In addition to being tapered, as shown in the previous embodiments, the tapered faces 60 shown in FIGS. 5*a*-5*d* have a number of steps. In FIG. 5*a*, it can be seen how there is a first angled step 62 and a second angled step 64. W1, W2 and W3 are representative of the width, or distance, between the tapered face and the straight face on the opposite thereof. W1 is the widest and may taper slightly inward toward the first step 62. The first step 62 steps up to the beginning of W2. W2 may taper slightly toward the second step 64. Second step 64 steps up to W3 which may taper slightly toward the solid portion 56. The arrangements of the various widths W1, W2 and W3 and steps 62 and 64 allow for a good interference fit for a variety of sizes of tubular leg members.

Referring to FIG. 5*b*, the tapered face 60 is shown with a large tubular member 66 received therein. The diameter of the large tubular leg member 66 is slightly less than the first width W1, but greater than the second width W2. As such, when inserted into the channel, the large tubular member 66 abuts the first step 62. Referring back to FIG. 1, there are shown angles θ along the first step 62 and the second step 64. The angle θ is approximately equal to the angle θ shown in FIG. 1 formed by the intersection of the various tubular leg members. As such, the large tubular leg member 66 not only has an interference fit between the tapered face 60 and the respective straight face, but also abuts the first step 62 for a more secure fit.

Referring to FIG. 5*c*, there is shown the tapered face 60 when a medium size tubular leg member 68 is received therein. The medium sized tubular leg member 68 has a diameter less than the width W1 but greater than the width W3. As such, the medium sized tubular leg member 68 fits within width W2, and abuts the second step 64. As W2 may decrease slightly between the first step 62 and second step 64, an interference fit may be achieved before the medium sized tubular member 68 abuts the second step 64.

Figure 5D:
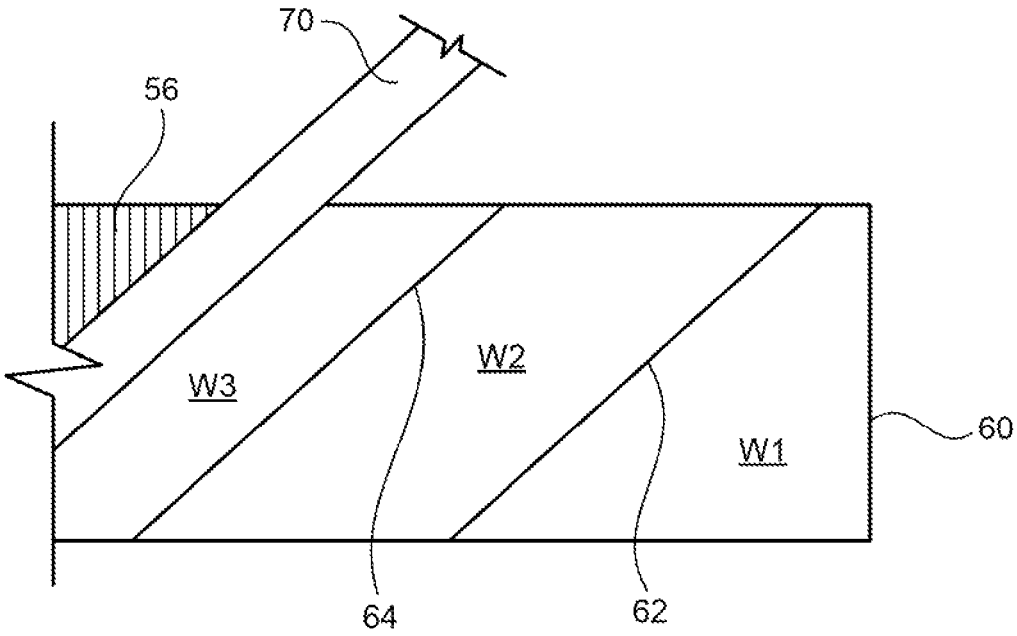
FIG. 5*d* is an isolated view of the face as shown in FIG. 5*a*, wherein a small diameter tubular leg member is received by the channel.

Referring to FIG. 5*d*, there is shown the tapered face 60 wherein a small diameter tubular leg member 70 is received therein. The small diameter tubular leg member 70 has a diameter less than widths W1 and W2, and as such abuts against the angled solid portion 56 adjacent W3. The solid portion 56 will accommodate any tubular leg member smaller than W1, W2 and W3. The angled nature of the solid portion 56 allows for even the small diameter tubular leg members to be accommodated by the channels of the utility tray apparatus of the present invention.

Figure 6:
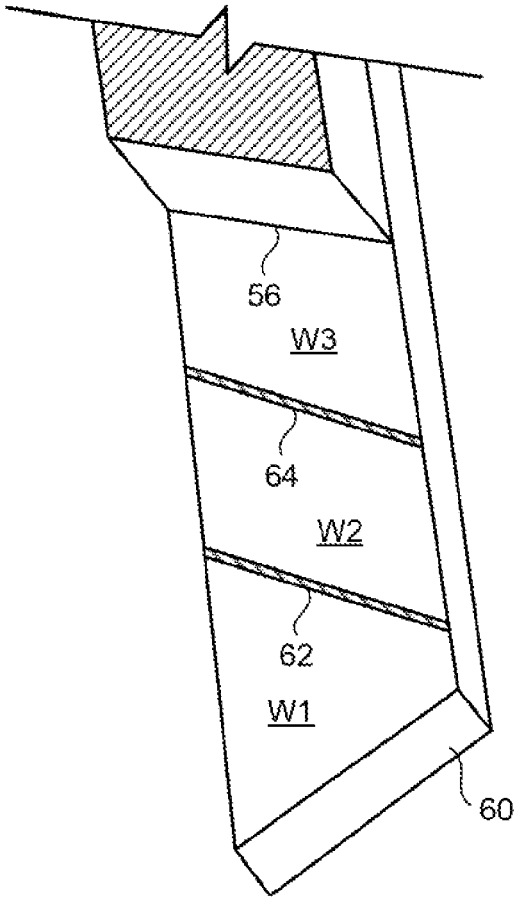
FIG. 6 is another isolated perspective view of the tapered face of one of the channels showing the angled steps thereon.

Referring to FIG. 6 there is shown an isolated, partially cross-sectional view of the tapered face 60. In FIG. 6, the configurations of the first step 62, second step 64 and solid portion 56 can be more easily seen.

Figure 7:
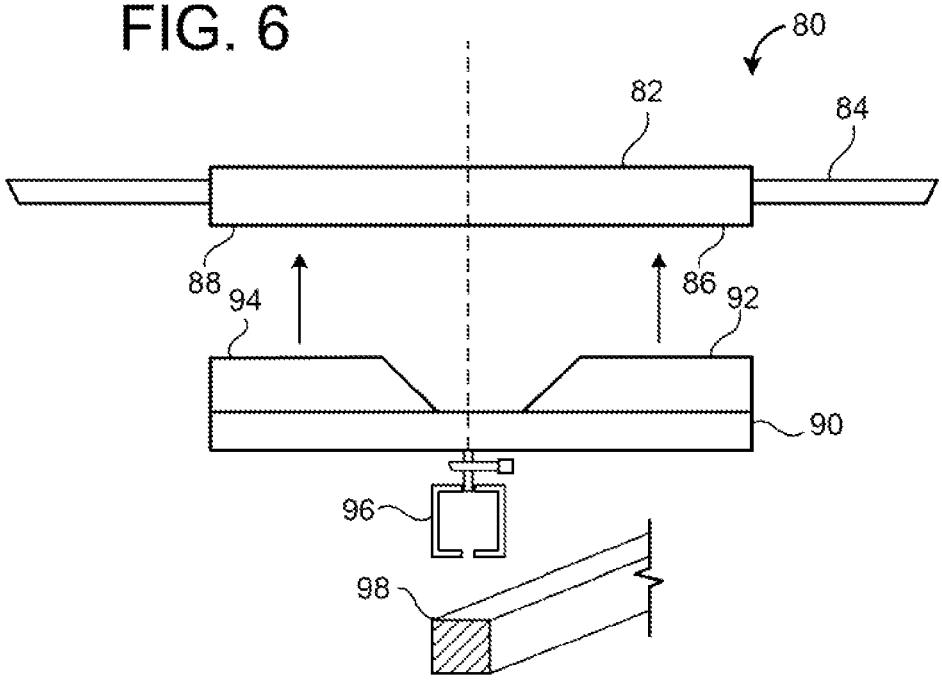
FIG. 7 is a schematic view showing the utility tray apparatus of the present invention having an additional attachment for affixing the tray to other surfaces.

Referring to FIG. 7, there is shown an additional feature of the present invention. In FIG. 7, a utility tray apparatus 80 is shown similar to the previous embodiments. The utility tray apparatus 80 has a body portion 82 and a tray portion 84. First channel 86 and second 88 are formed within the bottom of the body portion 82. The channels 86 and 88 can take the form of a generally tapered channel as shown in FIG. 2 or a stepped, tapered channel as shown in other figures. Importantly, an attachment 90 is also shown in FIG. 7.

The attachment 90 has a first male portion 92 and a second male portion 94. The male portions 92 and 94 are shaped so as to be received within and fill the spaces within the first channel 86 and the second channel 88. As such, by placing the attachment 90 with male portions 92 and 94 in the channels 86 and 88 of the body portion 82, the attachment 90 is secured beneath the body portion 82. The attachment 90 includes a clamping member 96 affixed to a bottom surface thereof.

The clamping member 96 is suitable for clamping the utility tray apparatus 80 to another surface, such as a square tubing 98 as shown in FIG. 7. The clamping member 96 can take a number of configurations so as to clamp the utility tray apparatus to any number of surfaces such as those found on deer stands, all-terrain vehicles, golf carts and other items. The attachment 90 and clamping member 96 adds to the versatility of the utility tray apparatus 80. As such, a user may utilize the utility tray apparatus 80 on a camp chair while attending a football tailgate on one day and can then utilize the utility tray apparatus on a deer stand when hunting on another.

A tray having a similar structure may also be suspended on an all-terrain vehicle, golf cart, or other moving vehicle. In this alternative embodiment, the attachment member may be suspended under a swivel member attached to the moving vehicle. The tray portion would be placed over the attachment member. When the vehicle is moving, the swivel member would compensate for movement of the vehicle, allowing items placed on the tray to remain relatively level. In this embodiment, the clamping portion of the attachment member may be removably affixed to the bottom thereof.

The disadvantages of the prior art are clearly overcome by the structure of the present invention. The utility tray apparatus of the present invention is easily attached, detached and stored. No hardware is required to attach the utility tray apparatus to a chair and the utility tray apparatus can be easily be removed and stored in a bag for transport. The tapered nature of the channels of the utility tray apparatus allowed to be used on all sizes of foldable chairs. Currently, the diameters of the tubular leg members are approximately between 16 and 22 millimeters and the various steps and channels can be formed accordingly. However, other sizes could be accommodated by adjusting the size of the channels of the present invention.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus attachable to a folding chair, the apparatus comprising:

a tray;

a body portion affixed to said tray, said body portion having a first end and a second end;

a first channel formed in said body portion, said first channel opening to said first end of said body portion and extending toward a center of said body portion, said first channel having a width decreasing from said first end of said body portion toward said center of said body portion; and a second channel formed in said body portion, said second channel opening to said second end of said body portion and extending toward said center of said body portion, said second channel having a width decreasing from said second end of said body portion toward said center of said body portion, each of said first channel and said second channel comprising:

a first face extending parallel to a longitudinal axis of said body portion; and a second face opposite said first face, said second face extending at an acute angle relative to said longitudinal axis of said body portion.

2. The apparatus of claim 1, said first face of said first channel being in alignment with said first face of said second channel.

3. The apparatus of claim 1, the folding chair having a first tubular leg and a second tubular leg in a crossed configuration, said first channel suitable for interference fit with the first tubular leg of the folding chair, said second channel suitable for interference fit with the second tubular leg of the folding chair.

4. The apparatus of claim 1, said second face of said first channel having an angular step defining a first width and a second width between said first face of said first channel and said second face of said first channel.

5. The apparatus of claim 1, said second face of said second channel having an angular step defining a first width and a second width between said first face of said second channel and said second face of said second channel.

6. The apparatus of claim 1, further comprising:

a cantilever member affixed to and extending outwardly from said body portion, said cantilever member being affixed to or formed with said tray.

7. The apparatus of claim 1, said first channel having an abutment surface opposite said first end of said body portion, said second channel having an abutment surface opposite said second end of said body portion.

8. The apparatus of claim 1, said first and second channels in combination defining a female portion, the apparatus further comprising:

a male portion engageable with said female portion, said male portion having a clamping means for clamping said male portion to a surface thereunder.

9. An apparatus comprising:

a folding chair having a first tubular leg and a second tubular leg in a crossed configuration;

a body portion having a first end and a second end;

a first channel formed in said body portion, said first channel opening to said first end of said body portion and extending toward a center of said body portion, said first channel having a width decreasing from said first end of said body portion toward said center of said body portion, said first channel suitable for interference fit with said first tubular leg of said folding chair; and a second channel formed in said body portion, said second channel opening to said second end of said body portion and extending toward said center of said body portion, said second channel having a width decreasing from said second end of said body portion toward said center of said body portion, said second channel suitable for interference fit with said second tubular leg of said folding chair, said first channel and said second channel each having a stepped configuration.

10. The apparatus of claim 9, further comprising:

a tray affixed to said body portion.

11. The apparatus of claim 9, said first channel having an abutment surface opposite said first end of said body portion, said second channel having an abutment surface opposite said second end of said body portion.

12. A tray table attachable to a folding chair and other items, the tray table comprising:

a tray;

a body portion affixed to said tray, said body portion having a first end and a second end;

a first channel formed in said body portion, said first channel opening to said first end of said body portion and extending toward said center of said body portion, said first channel having a width decreasing from said first end of said body portion toward said center of said body portion; and a second channel formed in said body portion, said second channel opening to said second end of said body portion and extending toward said center of said body portion, said second channel having a width decreasing from said second end of said body portion toward said center of said body portion;

a male member engageable within said first channel and said second channel, said male portion having a clamping means for clamping said male portion to a surface thereunder.

13. The tray table of claim 12, each of said first channel and said second channel comprising:

a first face extending parallel to a longitudinal axis of said body portion; and a second face opposite said first face, said second face extending at an acute angle relative to said longitudinal axis of said body portion.

14. The apparatus of claim 13, said first face of said first channel being in alignment with said first face of said second channel.

15. The tray table of claim 12, the folding chair having a first tubular leg and a second tubular leg in a crossed configuration, said first channel suitable for interference fit with the first tubular leg of the folding chair, said second channel suitable for interference fit with the second tubular leg of the folding chair.

16. The tray table of claim 15, said second face of said first channel having an angular step defining a first width and a second width between said first face of said first channel and said second face of said first channel.

17. The tray table of claim 15, said second face of said second channel having an angular step defining a first width and a second width between said first face of said second channel and said second face of said second channel.

18. The tray table of claim 12, said clamping means for clamping the tray table to a square or circular tubular member.

* * * * *